United States Patent [19]

Lemke

[11] Patent Number: 4,800,236

[45] Date of Patent: Jan. 24, 1989

[54] CABLE HAVING A CORRUGATED SEPTUM

[75] Inventor: Timothy A. Lemke, Carlisle, Pa.

[73] Assignee: E. I. Du Pont de Nemours and Company, Wilmington, Del.

[21] Appl. No.: 67,767

[22] Filed: Jul. 8, 1987

Related U.S. Application Data

[63] Continuation-in-part of Ser. No. 892,300, Aug. 4, 1986, abandoned.

[51] Int. Cl.[4] ..... H01B 7/08; H01B 13/22

[52] U.S. Cl. ..... 174/36; 156/53; 156/54; 174/113 R; 174/117 F

[58] Field of Search ..... 174/27, 36, 113 R, 103, 174/117 F, 117 FF; 156/51–54

[56] References Cited

U.S. PATENT DOCUMENTS

| | | | |
|---|---|---|---|
| Re. 31,277 | 6/1983 | Gabriel et al. | 174/36 |
| 252,634 | 1/1882 | Waring | 174/117 F |
| 1,843,837 | 2/1932 | Romeiser | 174/117 F |
| 3,404,217 | 10/1968 | Kelly . | |
| 3,422,214 | 1/1969 | Kelly . | |
| 3,601,756 | 8/1971 | Stroh | 339/19 |
| 3,622,683 | 11/1971 | Roberts et al. | 174/36 |
| 3,634,782 | 1/1972 | Marshall | 174/36 X |
| 3,663,739 | 5/1972 | Chevrier | 174/36 |
| 3,673,315 | 6/1972 | Lasley | 174/36 X |
| 3,763,306 | 10/1973 | Marshall | 174/115 |
| 3,775,552 | 11/1973 | Schumacher | 174/105 R |
| 4,155,613 | 5/1979 | Brandeau | 174/36 X |
| 4,218,581 | 8/1980 | Suzuki | 174/117 F |
| 4,323,721 | 4/1982 | Kincaid et al. | 174/36 |
| 4,340,771 | 7/1982 | Watts | 174/36 |
| 4,374,299 | 2/1983 | Kincaid | 174/36 |
| 4,404,424 | 9/1983 | King et al. | 174/34 |
| 4,453,031 | 6/1984 | Justiss | 174/36 |
| 4,487,992 | 12/1984 | Tomita | 174/36 |
| 4,551,576 | 11/1985 | Rich | 174/36 |
| 4,588,852 | 5/1986 | Fetterolf et al. | 174/36 |

FOREIGN PATENT DOCUMENTS

| | | | |
|---|---|---|---|
| 2644252 | 3/1978 | Fed. Rep. of Germany | 174/117 F |
| 412034 | 11/1966 | Switzerland . | |

*Primary Examiner*—Morris H. Nimmo

[57] ABSTRACT

A cable structure in round or flat form is characterized by a corrugated septum disposed intermediate an inner and an outer sheath. The septum contacts the sheaths to define tubular envelopes extending axially along the length of the cable. Each of the envelopes is able to receive a predetermined number of conductors. The sheaths and the septum are electrically connectable to a ground potential so as to totally electromagnetically isolate the conductors entirely along their axial lengths.

16 Claims, 8 Drawing Sheets

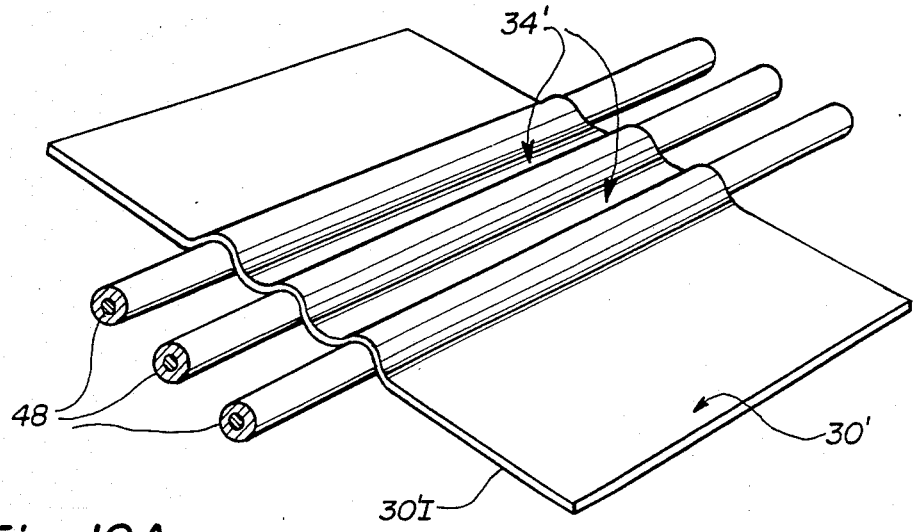
Fig. 10A
Fig. 10B
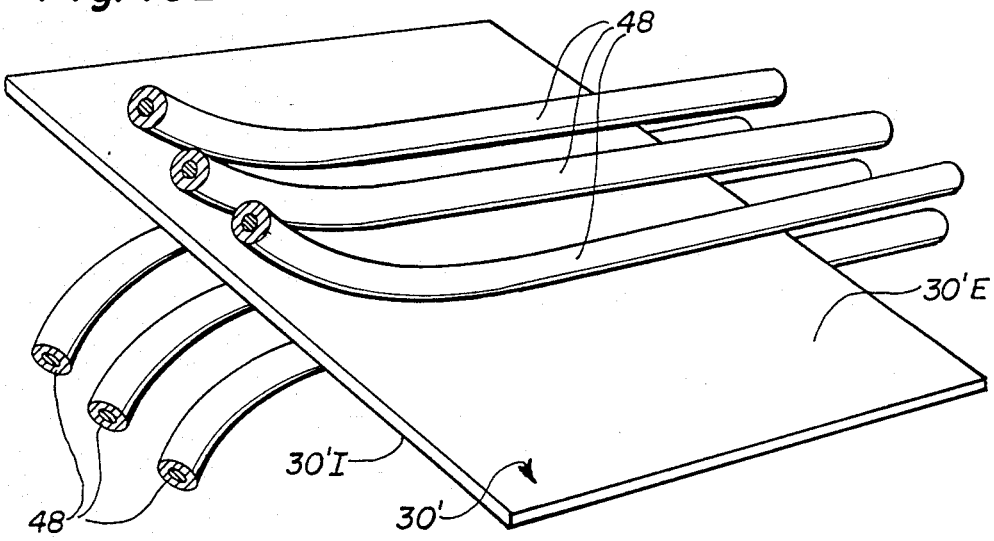

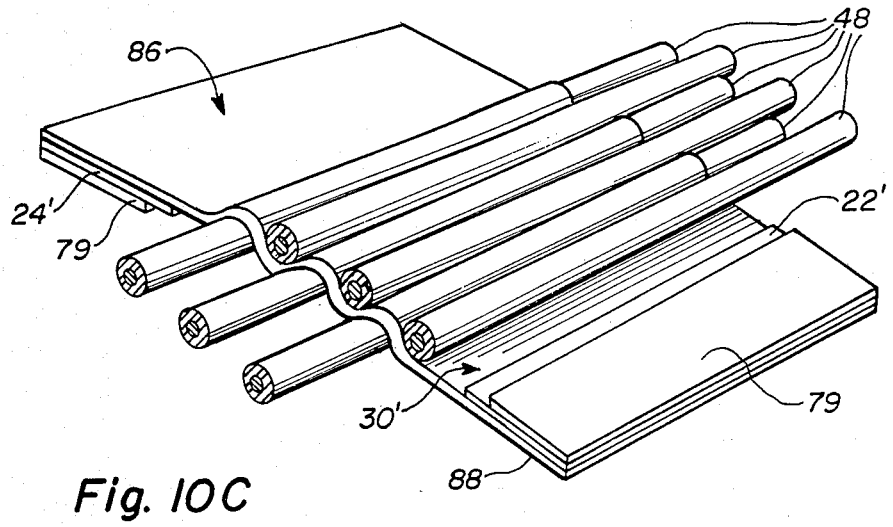
Fig. 10C
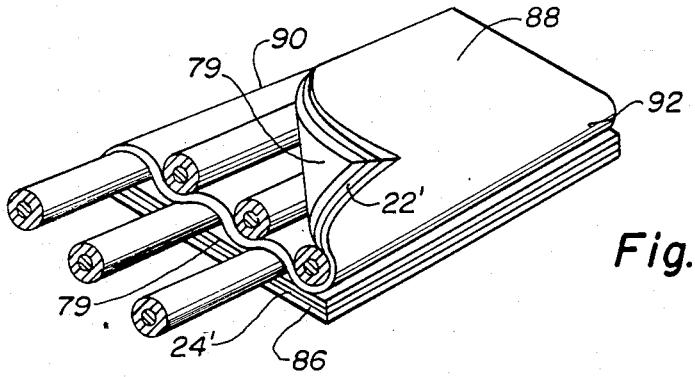
Fig. 10D
Fig. 10E
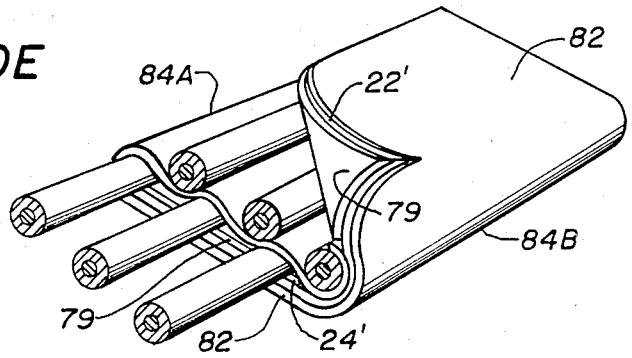

CABLE HAVING A CORRUGATED SEPTUM

CROSS REFERENCE TO RELATED APPLICATION

This application is a continuation-in part of copending application Ser. No. 892,300, filed Aug. 4, 1986 now abandoned.

BACKGROUND OF THE INVENTION

1. Field of the Invention

The present invention relates to an electrical cable for a transmission line in either round or flat form and, in particular, to an electrical cable having a plurality of conductors therein wherein each conductor or set of conductors is physically separated and electromagnetically isolated along their entire axial length by a corrugated septum.

2. Description of the Prior Art

Round cables are presently used for relatively high speed data transmission between various system components in data processing networks. Such cables utilize twisted pairs of conductors to achieve the necessary electrical characteristics, particularly characteristic impedance and cross-talk control.

One such cable arrangement is that sold by Hewlett-Packard as the HPIB cable. This cable includes concentrically spaced inner and outer conducting members disposed about a central, axially extending core. The inner member is typically a metallized film sheath while the outer member is a metallized film sheath surrounded by a metallic braid. A first layer of twisted pairs of conductors is disposed in the annular space defined between the core and the inner surface of the inner conducting member while a second layer of twisted pairs of conductors is disposed in the annular space between the outer surface of the inner member and the inner surface of the outer conducting member. The conductors in the inner layer are used as data transmission lines while the conductors in the outer layer serve as control lines. One conductor in each twisted pair carries the appropriate data or control signal while the other of the conductors in that pair serves as the signal return for that signal. In typical usage the inner conducting member is electrically grounded and acts to isolate the data pairs from the control pairs.

A round cable assembly as described above is bulky and generally expensive to manufacture due to its complexity. Twisted conductor pairs result in an overall diameter of the twisted pair cable that is significantly larger than that of standard cables. Such a twisted pair cable can range from twenty to fifty percent larger than a standard cable depending upon conductor size and the number of conductors. These factors also result in a relatively stiffer cable construction which must be carefully fabricated in order to prevent failure due to cable flexing. Twisted pair cables often do not exhibit a uniform cross-section and can thus present problems when using automatic stripping apparatus. Furthermore, providing the appropriate terminations at each end of each cable is a relatively labor intensive endeavor since before the ends of the conductors can be terminated in a suitable connector the conductors comprising each twisted pair must be untwisted.

Despite their problems twisted pair cables are utilized because they provide electrical characteristics that are closely comparable to the electrical characteristics of coaxial cable. Of course, the cost of coaxial cable prevents its widespread use in the environment here discussed.

The cable disclosed and claimed in U.S. patent application Ser. No. 06/769,725, filed Aug. 27, 1985, a continuation-in-part Ser. No. 670,948, filed Nov. 13, 1984 both now abandoned, assigned to the present assignee provides a cable assembly using ordinary individual jacketed conductors arranged in a form that is less expensive to manufacture, less bulky and more flexible when manufactured and yet provides substantially equivalent or better electrical characteristics than are available in a cable using twisted pairs. Moreover, the relatively less expensive material cost associated with individual jacketed conductor as compared to twisted pairs leads one to form a cable from such conductors.

This cable, also known as the HPIB-II cable, uses insulated jacketed conductors arranged in an annular array in the annular space defined between an inner and an outer metallic sheath. Alternate ones of the insulated jacketed conductors in the array are designated as signal carrying conductors. The remaining conductors are electrically connected to the metallic sheaths. When the sheaths and the conductors associated with the sheaths are connected to a predetermined ground potential a cable is defined which permits each signal carrying conductor to be electrically isolated along its entire axial length. However, the grounding of alternate ones of the individual conductors eliminates their use as signal carrying conductors, thus limiting the density of the cable.

The above-mentioned application also discloses and claims a cable which overcomes this limitation by having the remaining conductors used as signal return lines. The metallic sheaths assist in partially shielding the signal carrying conductors, but a sacrifice of some electrical performance over the totally isolated case occurs.

In view of the foregoing it is believed advantageous to provide a cable structure that utilizes ordinary insulated jacketed conductors, makes maximum use of such conductors for signal carrying purposes, and yet electromagnetically isolates each signal carrying conductor along its entire axial length. In addition, it is believed advantageous to use ordinary jacketed conductors in both round and flat cable forms which maintains total electromagnetic isolation of the conductors along their entire axial length, thus approximating closely the electrical performance of a coaxial cable.

SUMMARY OF THE INVENTION

The present invention relates to a cable structure, in either round or flat form, which utilizes ordinary insulated jacketed conductors and which includes a corrugated separating member, or septum, to electromagnetically isolate each conductor along its entire length. In its broadest aspect, the septum has opposed surfaces each having a groove formed therein with a conductive layer disposed in each groove. The conducting layers are in electrical contact. An ordinary insulated jacketed conductor is disposed in each groove, with the axes of the conductors lying on a common locus. The conductive layers are, in use, maintained at a predetermined electrical potential such that each conductor is electromagnetically isolated along its entire axial length.

In one aspect, the septum is used in a round cable configuration that includes an inner and an outer conducting member, or sheath, concentrically arranged to define an annular axially extending volume on the interior of the cable. The corrugated septum has a plurality of alternating ridges and grooves and is disposed in the annular volume, with each of the ridges contacting against the surface of the sheath to which it is radially proximal. As a result a plurality of axially extending substantially tubular envelopes are defined. At least one conductor is disposed in each of the envelopes with the axes of the conductors lying on a circular locus. In use, the sheaths as well as the corrugated septum are electrically connected to a predetermined electrical potential, typically ground potential, such that each of the conductors is totally electromagnetically isolated along its entire length. Such a cable structure utilizes each of the conductors as a signal carrying conductor, while at the same time provides electrical characteristics that closely approximate the characteristics of coaxial cable.

In another aspect the invention relates to a preferred method for manufacturing a round electrical cable as described comprising the steps of providing an elongated inner metallic sheath, and surrounding the inner sheath with an inner array of conductors. Each conductor is separated from the circumferentially adjacent conductor by a predetermined clearance distance. A flexible tape having upper and lower conducting surfaces thereon is loosely spirally wrapped about the inner conductor array with each wrap of the tape edgewise overlapping the previously laid wrap. An outer array of conductors is spirally wrapped about the flexible tape so that the conductors in the second array radially register with the circumferential spaces in the inner array. The resulting structure is then radially compressed such that the axes of each of the conductors in the inner and outer arrays lie on substantially the same radius as measured from the axis of the cable. An outer metallic sheath is wrapped about the exterior of the second array of conductors. In the resultant structure the corrugated septum is defined by the flexible tape that is caused to sinuously surround the conductors in the inner and outer arrays. Overlapping the edges of the flexible tape and the subsequent compressing of the assembled structure insures the electrical interconnection of the septum and the inner and outer sheaths.

In yet another aspect the corrugated septum is substantially planar in configuration with the axes of the conductors lying on a linear locus. The conductors are thus at least partially isolated over their entire axial lengths. To totally electromagnetically isolate the conductors the conductive members are disposed adjacent to each surface and in contact with the conductive layers in the grooves on the surface to which the conductive member is adjacent. Such a structure results in the definition of totally enclosed envelopes in which each conductor is disposed and in which it is totally electromagnetically isolated. In one embodiment the septum has a single flap integrally formed along one edge thereof. Both conductive members are disposed on this flap. When the flap is folded along a first and a second fold line each conductive member is placed into contact with the conductive layers on one surface of the septum. In an alternate embodiment the septum has a pair of flaps, one of which is integrally formed along each longitudinal edge of the septum. A conductive member is disposed on each flap. When folded along a fold line each flap overlies a surface of the septum so that the conductive member on that flap is placed into contact with the conductive layers on that surface of the septum which it overlies.

In still another aspect the present invention relates to a method of manufacture of a flat cable as above described.

BRIEF DESCRIPTION OF THE DRAWINGS

The invention will be more clearly understood from the following detailed description thereof, taken in connection with the accompanying drawings which form a part of this application and in which:

FIGS. 10A through 10E are diagrammatic illustrations of a method for manufacturing a flat cable in accordance with the present invention.

DETAILED DESCRIPTION OF THE INVENTION

Figure 1:
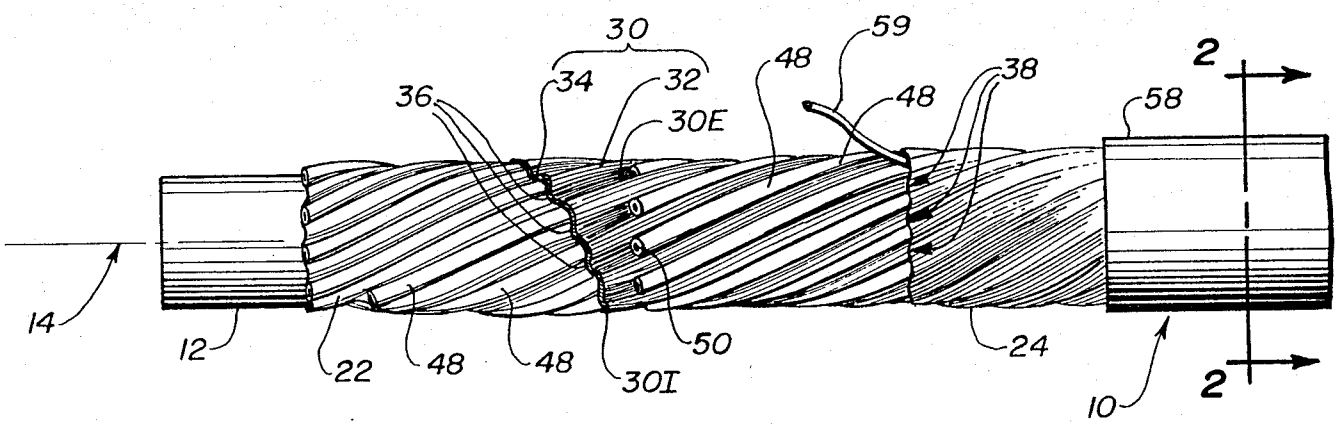
FIG. 1 is a side elevational view of a round cable in accordance with the present invention with the various elements of the cable being axially stepwise spaced for illustrative purposes.

Throughout the following detailed description similar reference characters refer to similar elements in all Figures of the drawings.

Figure 2:
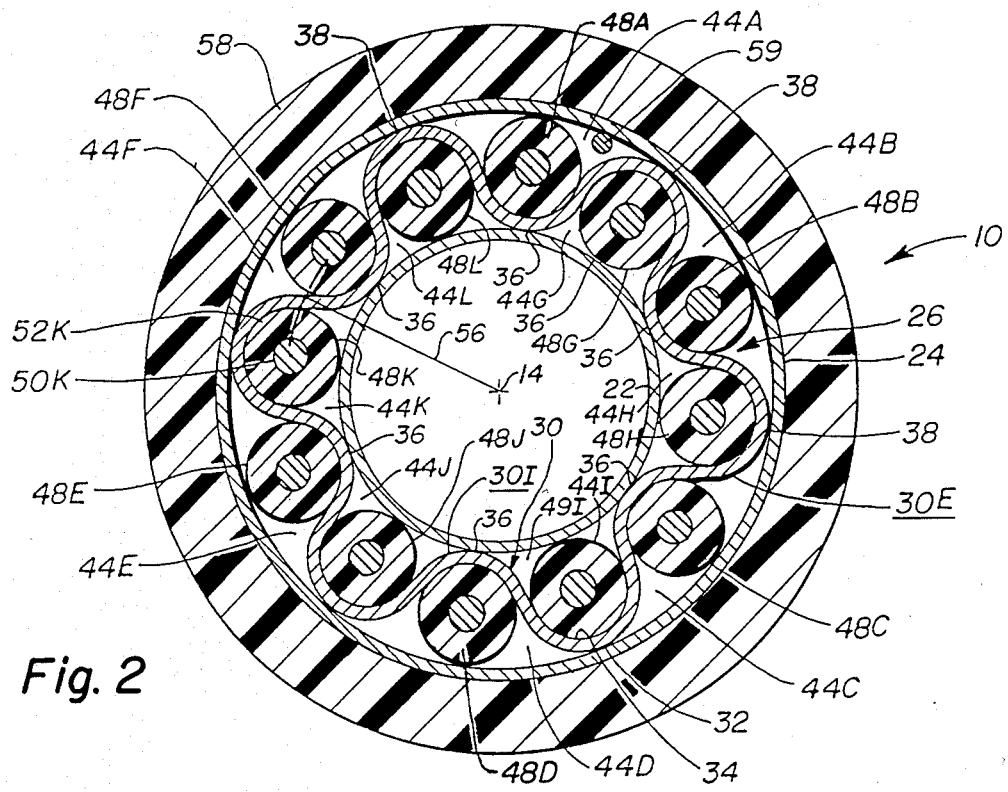
FIG. 2 is a sectional view taken along section line 2—2 of FIG. 1 illustrating a cable arrangement having a single insulated jacketed conductor in each electromagnetically isolated envelope.

Referring to FIGS. 1 and 2 respectively shown in side elevation and in section is a round cable generally indicated by reference character 10 in accordance with the present invention. The cable 10 includes a central axially extending elastomeric filler, or core, 12 (FIG. 1) having a central axis 14 of the cable extending therethrough. The core 12 may be omitted, if desired. It should be noted that in FIGS. 2 through 5 the core 12 is omitted from the drawings for clarity of illustration.

An inner conducting member, or sheath, 22 surrounds the core 12. Spaced a predetermined radial distance outward from the inner sheath 22 is a second, radially outer, conducting member, or sheath 24. The inner and outer sheaths 22 and 24 cooperate to define an axially extending annular volume 26 (FIG. 2) on the interior of the cable. Each sheath 22, 24 may be provided in any suitable form, such as a spiral winding of a metal foil, a metallized plastic film, a metallic braid or a metallic served shield.

Disposed in the volume 26 defined between the inner and outer sheaths 22, 24 is a corrugated septum 30 having an array of corresponding ridges 32 and grooves 34 formed therein. The septum 30 is positioned in the volume 26 such that the peaks of the ridges 32 on the inner surface 30I of the septum 30 contact against the inner sheath 22, as indicated at contact points 36. The contact points 36 between the sheath 22 and the septum 30 extend throughout the axial length of the cable 10. Similarly, the peaks of the ridges 32 on the outer surface 30E of the septum 30 contact against the inner surface of the outer sheath 24 throughout the axial length of the cable 10, as indicated by the contact points 38. The septum 30 may be formed from a suitable plastic material so long as at least the inner surface 30I and the outer surface 30E of the septum 30 are provided with a coating or layer of a conducting material. Alternately, the septum 30 may be formed entirely from a conducting material, such as a metallic foil.

The cooperative interaction of the corrugated septum 30 and the inner and outer sheaths 22, 24, respectively, defines a plurality of enclosed, substantially tubular regions, or envelopes, 44A through 44L extending axially along the interior of the cable. A conductor 48A through 48L is disposed respectively in each of the tubular envelopes 44A through 44L. Each conductor 48A through 48L includes a central current carrying wire 50 surrounded by an insulating jacket 52 as illustrated in connection with the conductor 48K. Preferably the wires 50 for the individual conductors 48 are each 30 AWG annealed tinned copper. Polyolefin or fluorocarbon material may be used as the insulating jacket 52 for the individual conductors. It should, however, be understood that any suitable conductors may be used in the cable of the present invention including bare wire conductors, assuming proper precautions are taken to insure that the individual conductors do not contact the septum 30 or the sheath 22, 24, as the case may be, forming the envelope 44 in which the conductor is disposed.

The conductors 48 are arranged in the envelopes 44 such that the axis of each of the conductors 48 lies on a substantially circular locus with each conductor axis being a predetermined distance 56 from the axis 14 of the cable 10. It should be understood, however, that such an arrangement is not necessarily required.

As may be seen from FIG. 2, the conductors 48A through 48F are received in the envelopes 44A through 44F that are defined by the radially outer surface 30E of the septum 30 and the outer sheath 24. These conductors may be construed to comprise one conductor array. Similarly, a second conductor array is comprised of the conductors 48G through 48L. These conductors are received in the corresponding envelopes 44G through 44L defined by the radially inner surface 30I of the septum 30 and the inner sheath 22. The number of conductors in each of the conductor arrays is equal.

Surrounding the exterior of the outer sheath 24 is an insulated jacket 58 preferably formed of thirty-five mil PVC per UL 2464.

Figure 3:
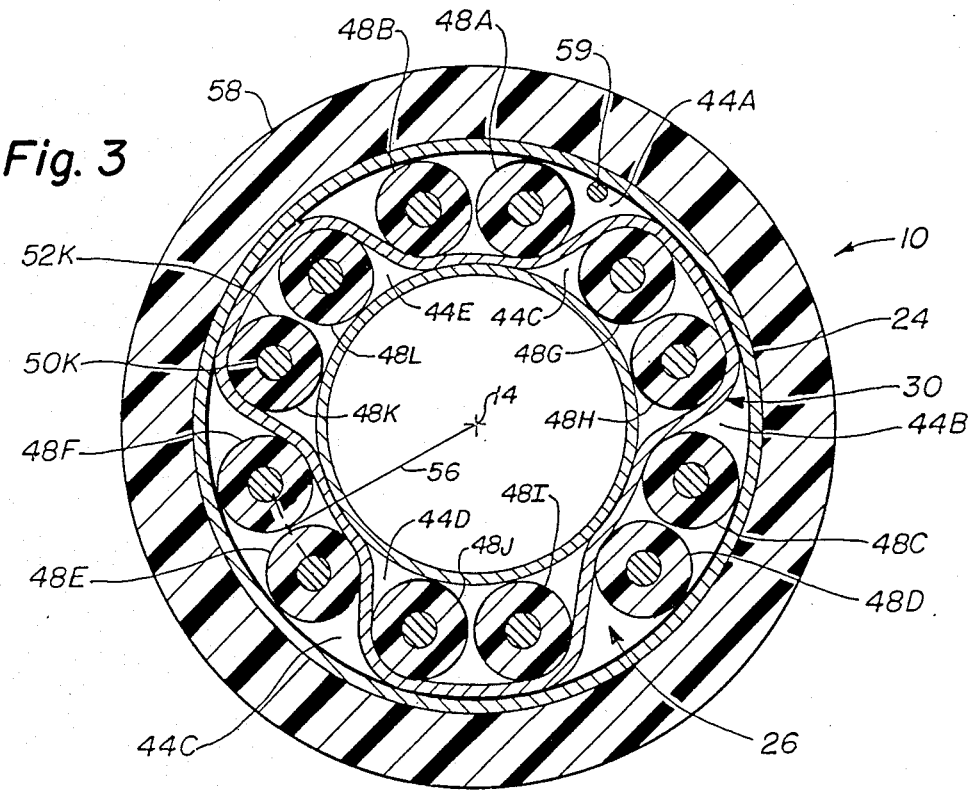
FIG. 3 is a sectional view similar to FIG. 2 illustrating a cable arrangement having a plurality of insulated jacket conductors in each electromagnetically isolated envelope.

As shown in the alternate embodiment of the cable 10 shown in FIG. 3, more than one conductor 48 may be disposed in each of the envelopes 44. Thus, for example, the envelope 44A contains the conductors 48A, 48B. In such an arrangement a balanced pair of conductors may be defined within each of the envelopes, with one of the conductors serving as a signal carrying conductor while the second of the conductors serves as the signal return.

It should also be understood that different envelopes may contain differing numbers of conductors and remain within the contemplation of this invention. For example, alternate envelopes may contain two conductors while the intermediate envelopes may carry only a single conductor. It is also possible in a cable having more than one conductor in a given envelope to stack the conductors radially with respect to the axis of the cable. In such an instance, of course, the axis of all the conductors would not lie the same predetermined radial distance from the axis of the cable.

In accordance with the present invention the inner sheath 22, the outer sheath 24, the inner surface 30I and the outer surface 30E of the septum 30 are electrically interconnected. Any suitable arrangement to effect this interconnection may be used and lie within the contemplation of the present invention.

Figure 4:
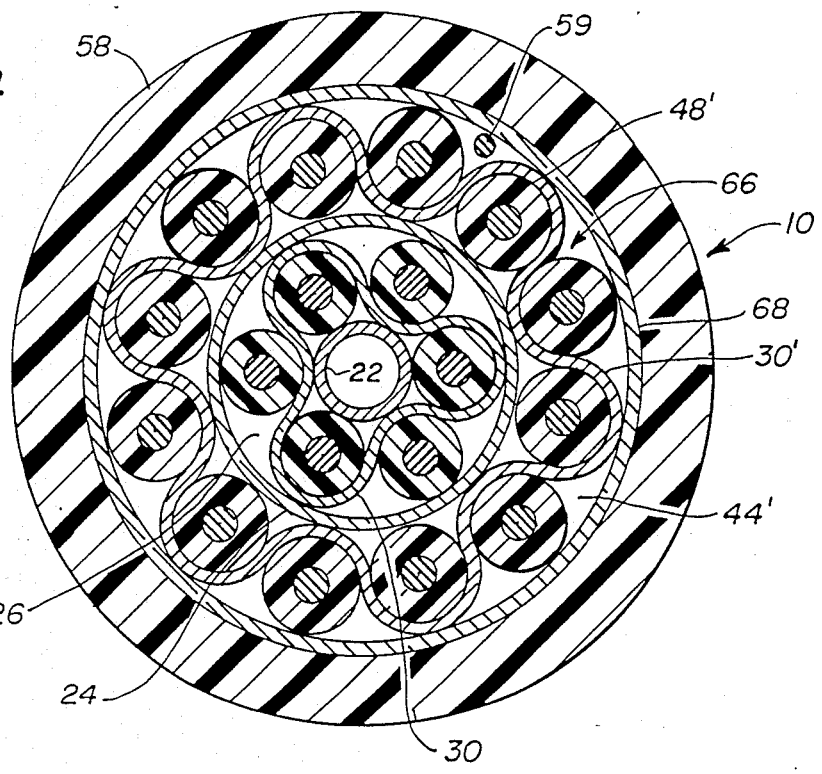
FIGS. 4 and 5 are sectional views similar to FIGS. 2 and 3, respectively, illustrating alternate embodiments of the present invention.
Figure 5:
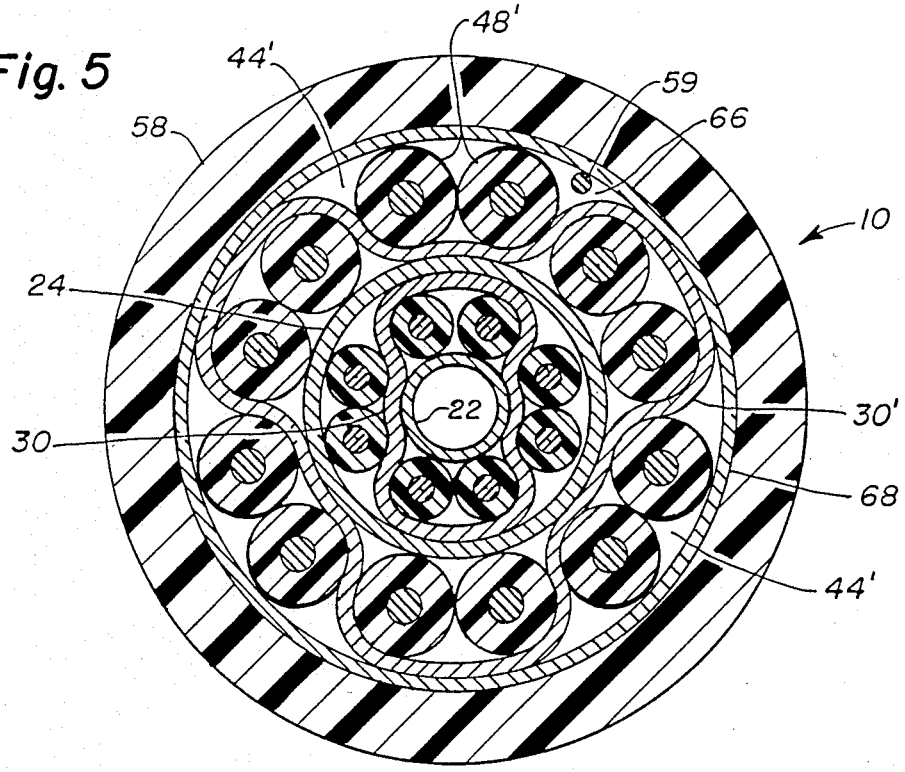

In addition, as seen from FIGS. 4 and 5, an additional annular volume 66 may be defined by the provision of an additional sheath 68 disposed radially outwardly of the sheath 24, thus placing that sheath 24 intermediate or medially between the outermost sheath 68 and the innermost sheath 22. Into the annular volume 66 so defined an additional septum 30′ is positioned so as to define another array of tubular envelopes 44′. Additional arrays of individual conductors 48′ are arranged in the envelopes 44′. These additional conductors 48′ may be identical to or different from the conductors 48. In the FIGS. 4 and 5, the conductors 48 and 48′ shown as slightly different in size to illustrate the possibility that a difference in conductors lies within the contemplation of this invention. Such arrangements are shown in FIGS. 4 and 5, which are, respectively, similar to the arrangements of conductors in each envelope as described in FIGS. 2 and 3. It should also be appreciated that the conductors in the inner array may be arranged in their respective envelopes in a manner that differs from the arrangement in the outer envelopes. The extension to more than two annular volumes should be readily apparent to those skilled in the art. Similarly, the interconnection of the sheaths and corrugated septum in each volume is also an extension of the teachings above presented.

Referring to FIGS. 6A through 6G shown in schematic diagram form are the steps useful to form the round cable 10 in accordance with the present invention. The steps may be manually effected, or an automated apparatus, such as a planetary cable winder, may be used.

Figure 6A:
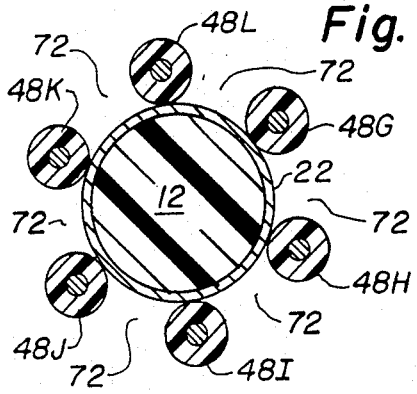
FIGS. 6A through 6F diagrammatically illustrate the method steps involved in manufacture of a cable in accordance with the present invention.
Figure 6B:
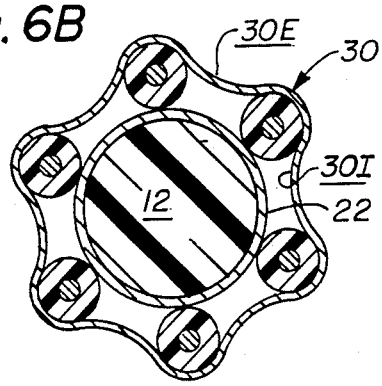

As seen in FIG. 6A, as a first step the inner metallic sheath 22 is provided over the core 12. This is effected, for example, by spirally wrapping a metallized foil about the core 12. The inner array of conductors 48G through 48L is next laid onto the central portion defined by the core 12 and inner sheath 22. The conductors are spirally wrapped about the inner sheath 22 such that a predetermined circumferential spacing 72 is defined between adjacent ones of the conductors 48G through 48L of the inner conductor array.

The septum 30 is then loosely spirally wrapped (FIG. 6B) about the inner array of conductors. In the preferred case the septum 30 is provided using a flexible metallized foil or tape having metallic inner and outer surfaces. The requisite contact between the inner surface 30I and outer surface 30E of the septum 30 is insured by having each succeeding spiral wrapping of the flexible metallized tape edgewise overlap the previously laid wraps.

The second, outer, array of conductors 48A through 48F is next laid (FIG. 6C) about the assembly such that the conductors of the outer array register with the spaces 72 between the circumferentially adjacent adjacent conductors of the inner array.

Figure 6C:
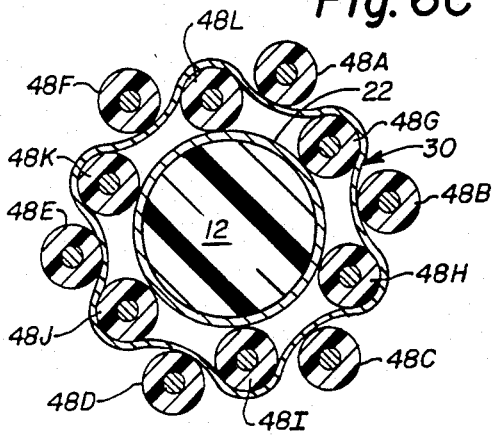
Figure 6D:
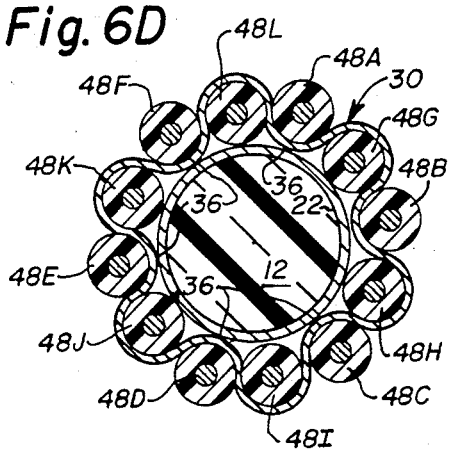

A radially inwardly compressive force is then applied to the structure of FIG. 6C to deform the outer array of conductors 48A through 48F as well as the flexible septum 30 into the structure shown in FIG. 6D. As a result, the axes of each of the conductors 48A through 48F in the outer array and the conductors 48F through 48L in the inner array lie on substantially the same radial distance from the axis of the cable. The compression imparts the corrugated shape to the septum 30. In addition, compressing the outer array of conductors brings the peaks of the ridges on the inner surface 30I of the septum 30 into contact with the inner sheath 22, as indicated by the contact points 36.

Figure 6E:
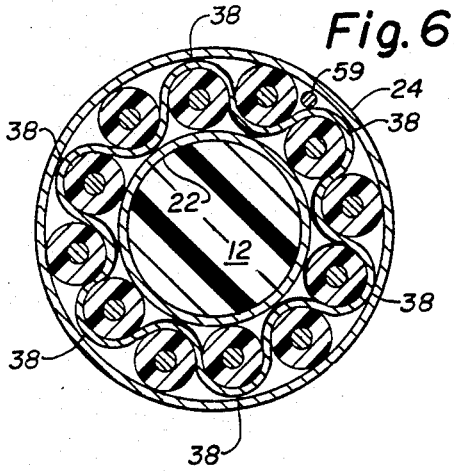

As seen from FIG. 6E, the outer metallic sheath 24 is provided about the outer array of conductors. This causes the peaks of the ridges on the outer surface 30E of the septum to contact against the outer sheath 24 at the contact points 38 and thus produces a structure wherein the inner sheath 22, the outer sheath 24 and the inner and outer surfaces 30I and 30E, respectively, of the flexible septum 30 into electrical contact with each other. Thus, each of the conductors 48A through 48L lies enclosed in a substantially tubular envelope throughout its entire axial length.

Figure 6F:
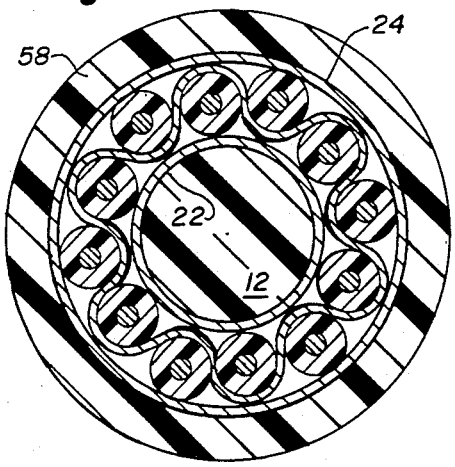

At any appropriate step the medium whereby the sheaths 22, 24 and the septum 30 are interconnected is introduced into the cable. For example, in FIG. 6E, the spiral drain wire 59 may be provided on the outer sheath 24 so as to lie within one of the envelopes. If the sheath 24 is realized by a metallic foil (without an intermediate insulating layer) then the drain wire 59 may be wrapped about the exterior of the sheath 24. For example, a bare drain wire 59 may be disposed within a selected envelope to effect the desired electrical interconnection. Other exemplary expedients whereby the sheaths and the septum may be interconnected include a contact foil, a braid, a spiral drain wire or a served shield. Thereafter, as shown in FIG. 6F, the insulated jacket 58 is provided over the cable assembly. If a cable as shown in FIGS. 4 and 5 is to be fabricated, the steps shown in FIGS. 6A through 6F repeated, using a structure shown in FIG. 6E (with the sheath 24 as the outside layer) as the central portion about which additional conductors are placed.

In operation, a predetermined electrical potential, typically ground potential, is applied to the interconnected sheaths 22, 24 and the surface of the septum 30 (and to the sheath 68 and septum 30', if provided, FIGS. 4 and 5). By applying the potential to these conducting members each of the conductors 48 enclosed within the individual envelopes is electromagnetically isolated and shielded. If a balanced pair of conductors are disposed in each of the envelopes (as, for example, in FIGS. 4 and 5), even higher levels of performance may be achieved.

It has been found that the structure of the cable 10 in accordance with the present invention provides electrical characteristics comparable to those produced by a coaxial cable.

Figure 7:
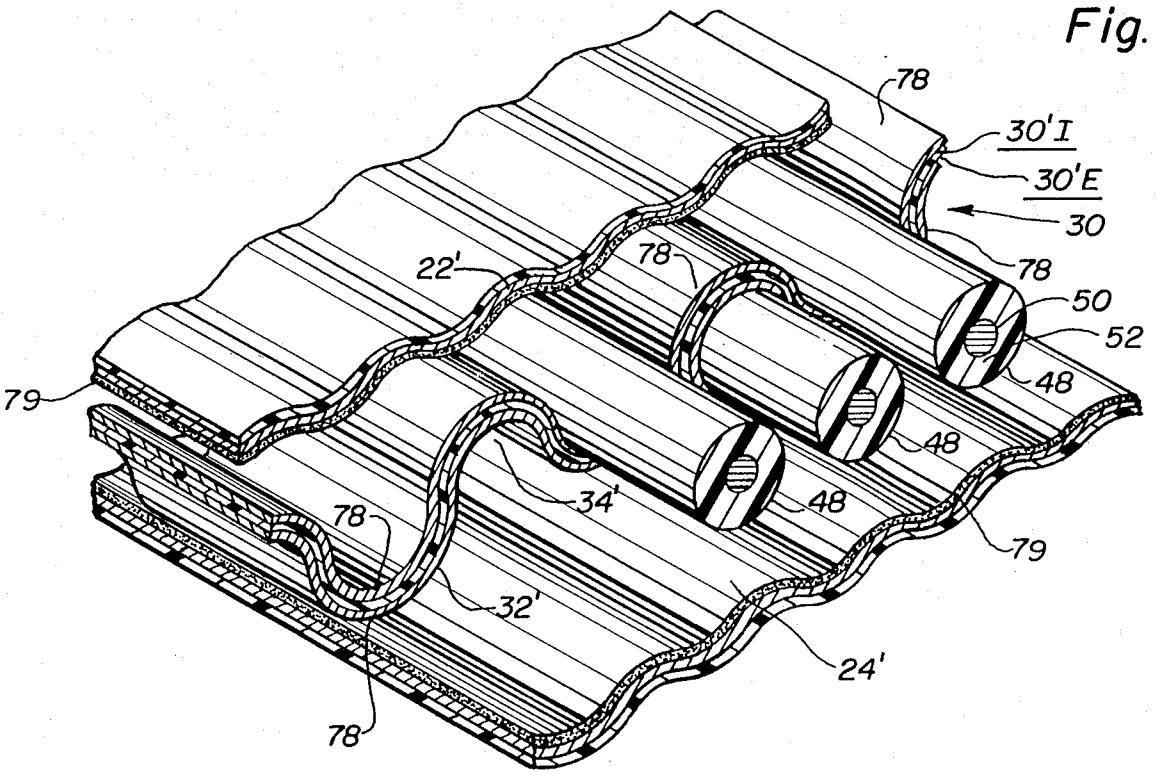
FIG. 7 is a perspective view of a flat cable in accordance with the present invention with various elements of the cable being axially stepwise spaced for illustrative purposes.

FIG. 7 illustrates a perspective view of a flat cable 10' also in accordance with the present invention. The cable 10' includes a corrugated septum 30' formed into a generally planar configuration. The septum 30' has extending ridges 32' and grooves 34' provided on opposed surfaces 30'I and 30'E thereof. The septum 30' may be formed from a suitable plastic material so long as conductive layers 78 are provided in each of the grooves 34' provided on the opposed surfaces 30'E and 30'I of the septum 30'. The conductive layers 78 may be arranged in the form of separated stripes on each surface, or the layers 78 may be continuous over each surface. Alternately the septum 30' may be formed entirely from a metallized plastic film or from a conductive material, such as a metallic foil. In the FIGS. 7 through 10 the conductive layers 78 are shown as being continuous over the surface of the septum 30'. In whatever manner provided, the conductive layers 78 lying in the grooves 34' on each surface of the septum 30' are in electrical contact with each other so as to be connectible to a common potential. The electrical interconnection between the layers 78 may be effected in any convenient fashion. For example, the layers 78 from opposed surfaces of the septum 30' may be contacted with each other, as by folding, at the axial ends or lateral edges of the cable. Alternatively bare drain wires (e.g., the wires 59' in FIGS. 8 and 9) could be provided, with each drain wire being connected to a layer 78 by mechanical contact. The drains themselves are interconnected or connected to a common potential.

Disposed in each of the grooves 78 is an insulated jacketed conductor 48. The conductors 48 disposed in the grooves 34' formed in one side 30'E of the septum 30' define a first array of conductors, while the conductors 48 disposed in the opposed surface 30'I of the septum 30' define a second conductor array. In any event, the axes of the conductors 48 in both arrays thereof lie on a common locus that takes a linear form.

In such a flat cable arrangement 10' as heretofore described, with the conducting layers 78 connected to a common (typically ground) potential, the individual conductors 48 are afforded some degree of electromagnetic isolation one from the other when the layers 78 are connected to the common potential. If desired sheath members formed of a nonconducting material, similar in form to the sheaths 22', 24' to be discussed, may be laid over the septum 30' to cover the grooves and the conductors 48 received therein. As will be developed, to provide structural integrity to the flat cable an adhesive layer is provided between these nonconducting sheath members and the septum 30'. Such nonconducting sheaths may also be used in place of the sheaths 22', 24' shown in the round cable of FIGS. 1 to 6.

However, in accordance with the more preferred embodiment of the invention a first and a second conductive member or sheath 22', 24' is respectively disposed adjacent one of the surfaces 30'E, 30'I of the septum 30'. The sheaths 22', 24' are shown in the drawing as formed of a metallized plastic film material, although it should be understood that a metal foil may also be used. The conductive sheaths 22', 24' are arranged to contact the ridges 34' on the respective surface of the septum 30' to which the sheath is adjacent to define the axially extending envelopes 44'. The sheaths 22', 24' are electrically interconnected to the layers 78 by mechanical contact therebetween. Any convenient alternate expedient may be used to connect the sheaths to the layers 78. For example, suitable single or multistrand bare drain wires 59' (not shown in FIG. 7 but seen in FIGS. 8 and 9) may be provided into an envelope on one side or on each side of the septum. The drains 59' may be inserted into any one of the grooves. The drain wires 59' are thus interconnected with the sheaths 22', 24' and the layers 78. The sheaths 22', 24' may, in such an arrangement, be themselves interconnected by connecting the drains together or to a common potential. Conductors 48, whether used with the round cable or with the flat cable, may be single or multi-strands of wire and may be jacketed with a foamed polyolefin or fluorocarbon material.

To provide structural integrity to the cable 10' shown in FIG. 7 in order to hold the same together a layer of adhesive 79 is disposed on the inner surfaces 22'I and 24'I of the sheaths 22' and 24', respectively. Any pressure sensitive adhesive, such as the acrylic adhesive transfer tape sold by 3M Corporation, Minneapolis, Minn. as tape No. 924 may be used. Alternatively any elastomeric, silicone, rubber, or plastic adhesive may be used. The adhesive 79 is disposed, as a minimum, along the ridges 32' on each side of the septum 30' at the points of mechanical contact between the sheaths 22', 24' and the septum 30'. In practice the adhesive 79 is disposed as a continuous layer on the inner surfaces of the sheaths 22', 24'. The presence of the adhesive layer does not significantly impair the requisite electrical contact between the sheaths 22', 24' and the septum 30'. Moreover, if the conductors 48 are jacketed with a polyolefin or fluorocarbon material, these jackets would not readily bond to the adhesive. Thus such jacketed conductors may move relatively to the septum and to the sheaths during bending, resulting in greater cable flexibility. The adhesive 79 causes the sheaths 22', 24' to adhere to the septum 30' and thereby imparts an integrity to the structure of the cable 10' so produced.

In cables where foamed insulating jackets are used for the conductors, the foams can be readily damaged, both during the manufacturing process, and during subsequent use since the foams are relatively fragile. Adhesively bonding the corrugated septum to the outer sheaths provides a semi-rigid structure which protects the fragile jackets of the conductors from stresses which are both compressive and tensile in mode. If the adhesive were not present, the tensile stresses would tend to pull the cable apart, the conductors would become disarrayed, and the electrical characteristics of the cable would be significantly changed.

If the adhesive were not used and compressive stresses were imparted to the cable, the corrugated septum could easily slide relative to the sheath and the conductors would be easily damaged. The adhesive bond prevents the septum from sliding relative to the sheath, and consequently the structure resists compression, thus protecting the relatively fragile conductors.

Figure 8:
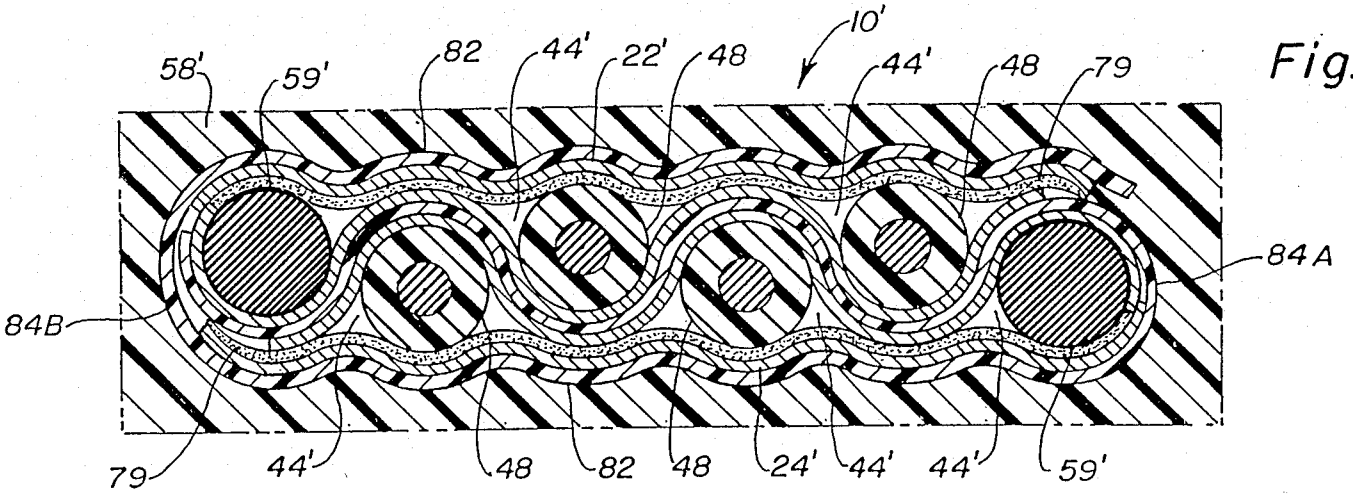
FIGS. 8 and 9 are sectional views taken along view lines 8,9–8,9 in FIG. 7 illustrating alternate embodiments of the flat cable of FIG. 7.
Figure 9:
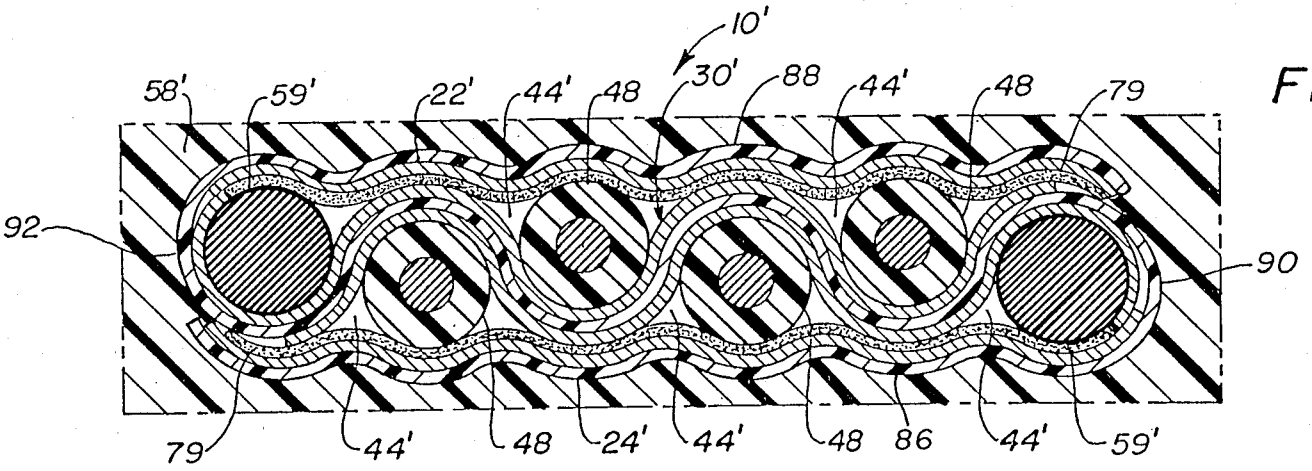

FIGS. 8 and 9 illustrate alternate embodiments of a flat cable 10' in accordance with the present invention. In the embodiment of FIG. 8 the septum 30' has a single flap 82 integrally formed therewith and extending along one longitudinal edge of the septum 30'. The conducting sheaths 22', 24' are defined as separate layers of conductive material on the surface of the flap 82. The flap 82, when folded along fold lines 84A and 84B, causes the conductive sheaths 22', 24' to overlie a respective surface of the septum 30' and contact the ridges thereon to define the envelopes 44'.

In the alternate arrangement shown in FIG. 9 the septum 30' is provided with a pair of flaps 86, 88 integrally formed along the opposed longitudinal edges of the septum 30'. The conductive sheaths 22', 24' are provided on a respective one of the flaps 86, 88. In this instance when each of the flaps 86, 88 is folded along an appropriate fold line 90, 92, respectively, the conductive sheaths 22', 24' are brought into overlying position with respect to a surface of the septum 30' thereby to contact the ridges 34' thereof to define the axially extending tubular envelopes 44'.

As is the case in the embodiment of the invention shown in FIG. 7 the layers of adhesive 79 are disposed on the inner surface of the single flap 82 (FIG. 8) and on the inner surfaces of the flaps 86, 88 (FIG. 9).

Large drain wires 59' are disposed in the grooves at at each lateral edge of the septum so as to lie at each lateral end of the linear array of conductors 48 provided in the cable 10'. The drains 59' should have outer diameter dimension of the same as those of the conductors 48. The drains 59' are provided primarily to terminate the sheaths. Secondly, when the foamed conductors are used as the conductors 48, the drains 59' at each lateral end of the linear array provide protection for the fragile foamed conductors. It should also be appreciated that the drains or other protective wires (whether or not interconnected in an electrical circuit) can be interspersed along the width of the linear array of conductors in order to provide mechanical protection for foamed conductors, if they be used in the cable. Thirdly, the drains 59' serve as strain relief for the cable 10' when a connector is added.

A suitable insulating jacket 58' is formed over the septum 30', whether or not the septum 30' is overlaid with the conductive sheaths 22', 24'.

As is the case in the circular cable discussed in conjunction with FIGS. 1 through 6, each tubular envelope 44' in the flat cable 10' may contain multiple conductors, or alternate ones of the envelopes may contain single conductors 48 while the other of the envelopes contain multiple conductors 48.

A flat cable 10' in accordance with the present invention may be fabricated using the steps shown in FIGS. 10A through 10E.

As shown in FIG. 10A an array of conductors is laid against on surface 30'I of the septum 30'. The septum is compressed against the array of conductors, thus imparting the corrugated shape thereto. A second array of conductors 48 may then be laid into the grooves 34' formed in the septum 30'. Alternately, as shown in FIG. 10B an array of conductors 48 is laid simultaneously against each surface of a resilient material used to form the septum 30'. The conductors 48 are laid with a gap defined therebetween such that when the conductors 48 and the septum 30' are exposed to a compressive force the corrugated shaped is imparted to the septum 30'. In each instance the compressive force must be applied either from the center of the septum 30' outwardly or from one side toward the other. By whatever alternative used, the structure shown in FIG. 10C is produced.

If sheaths 22', 24' are eliminated, the resultant structure shown in FIG. 10C is thereafter covered with a suitable insulating jacket. However, if sheaths 22', 24' are used, the further steps of the manufacturing process are dependent upon the form which the sheaths take. If each edge of the septum 30' is provided with a flap 86, 88, respectively (as illustrated in FIG. 10C), the flaps 86, 88 are provided with the adhesive layer 79 and folded, as shown in FIG. 10D; along their appropriate fold lines 90, 92, respectively to dispose the sheaths 22', 24' in their overlapping relationship to the septum 30'. If the single flap 82 is used, as shown in FIG. 10E, the single flap 82 provided with the adhesive 79 on those portions of the inner surface of the flap 82 and the flap 82 is folded along the fold lines 84A, 84B as shown in FIG. 10E to dispose the sheaths 22', 24' carried on the flap 82 in their overlapping relationship with respect to each surface of the septum. The resultant structure is then covered with the insulating jacket. The drain wires 59', if used, are provided on the flap (or flaps) so as to appropriately locate the drain.

As an alternate mode of manufacture a metallized plastic foil used to form the septum may be unwound from a supply reel and corrugated using a corrugator having a series of contoured rollers therein. The septum is corrugated first in the central region thereof, with the corrugations being formed progressively toward the lateral edges of the septum as the septum moves through the corrugator. Conductors and drains, as appropriate, are laid into selected grooves on each surface of the septum. The adhesive layer is then applied to the exposed portions of each surface of the septum and the conductors and drains. The backing of the transfer tape (identified earlier) is stripped therefrom as the tape is drawn from a supply roll and pressed onto the septum, conductors and drains as the assembly passes through a pair of nip rolls. Outer sheaths (whether of conducting or nonconducting material) are laid onto both surfaces of the septum. The lateral edges of the assembly so produced are trimmed to an appropriate width. The cable assembly may then be jacketed with a suitable insulating jacket 58, preferably formed of polyvinylchloride (PVC).

In view of the foregoing, those skilled in the art may readily appreciate that a cable, in round or flat form, in accordance with the present invention provides electrical performance substantially equal to that produced by a corresponding coaxial cable. However, since ordinary shielded cable has been used to form the cable 10, such performances has been achieved at a fraction of the cost. Those skilled in the art, having benefit of the teachings of the present invention as hereinabove set forth may effect numerous modifications thereto. However, such modifications are to be construed as lying within the scope of the present invention, as defined by the appended claims.

What is claimed is:

1. A cable comprising:

a corrugated member having a first and a second longitudinal edge thereon and opposed surfaces thereon, each surface having an open groove formed therein, a conductive layer being disposed in each of the grooves, the conductive layers being in electrical contact with each other, the corrugated member being substantially planar in configuration, an electrical conductor disposed in each of the grooves, each conductor having a central axis extending therethrough, the axes of the conductors lying on a common, substantially linear, locus, the corrugated member having a first and a second flap integrally formed along each respective longitudinal edge thereof, a first and a second substantially planar conductive member respectively disposed on each of the flaps, the flaps being foldable to overlie a respective surface of the corrugated member thereby to dispose each conductive member into contact with its respective conductive layer to close an open groove on each surface of the corrugated member and thereby to define an enclosed tubular envelope receiving each conductor along its entire axial length, the conductive members and the conductive layers being, in use, at a predetermined electrical potential such that each conductor in each envelope is substantially totally electromagnetically isolated along its entire axial length.

2. The cable of claim 1 wherein the conductive layer on the corrugated member is formed as a continuous metal layer on each surface of the corrugated member; and wherein the conducting members are defined as metal layers on the surface of each flap.

3. The cable of claim 1 wherein the corrugated member is formed from a metallic foil such that the conductive layers and conductive members are integral with the corrugated member.

4. A cable comprising:

a corrugated member having a first and a second longitudinal edge thereon and opposed surfaces thereon, each surface having an open groove formed therein, a conductive layer being disposed in each of the grooves, the conductive layers being in electrical contact with each other, the corrugated member being substantially planar in configuration, an electrical conductor disposed in each of the grooves, each conductor having a central axis extending therethrough, the axes of the conductor lying on a common, substantially linear, locus, the corrugated member having a flap integrally formed along one longitudinal edge thereof, a first and a second substantially planar conductive member disposed on the flap, the flap being foldable along two fold lines such that a portion of the flap overlies a respective surface of the corrugated member thereby to dispose each conductive member into contact with its respective conductive layer to close an open groove on each surface of the corrugated member and thereby to define an enclosed tubular envelope receiving each conductor along its entire axial length, the conductive members and the conductive layers being, in use, at a predetermined electrical potential such that each conductor in each envelope is substantially totally electromagnetically isolated along its entire axial length.

5. The cable of claim 4 wherein the conductive layer on the corrugated member is formed as a continuous metal layer on each surface of the corrugated member; and wherein the conducting members are defined as metal layers on the surface of each flap.

6. The cable of claim 4 wherein the corrugated member is formed from a metallic foil such that the conductive layers and conductive members are integral with the corrugated member.

7. A cable comprising:

a substantially planar corrugated member having opposed surfaces thereon, each surface having a plurality of open grooves formed therein, a conductive layer being disposed in each of the grooves, the conductive layers being in electrical contact with each other;

an electrical conductor being disposed in at least one of the grooves on each surface of the corrugated member, each conductor having an axis therethrough, the axes of the conductors lying on a common, substantially linear, locus;

a first and a second conductive member respectively disposed adjacent to each of the surfaces of the corrugated member and in electrical contact with the conductive layers on the surface of the corrugated member to which it is adjacent;

an adhesive layer disposed between each conductive member and the corrugated member, each conductive member and the conductive layer with which it is in contact cooperating to close the open groove having the conductor therein and thereby to define an enclosed tubular envelope, the envelope receiving the electrical conductor disposed therein along its entire length.

the conductive members and the conductive layers being, in use, at a predetermined potential such that each conductor is substantially totally electromagnetically isolated along its entire axial length.

8. The cable of claim 7 wherein the conductors comprise a wire surrounded by an insulating jacket formed of a foamed plastic material.

9. The cable of claim 8 wherein the corrugated member has a groove adjacent each lateral edge thereof, and wherein a drain wire is disposed in each such groove, the drain wires each being dimensioned the same as the dimensions of the conductors.

10. A cable comprising:

a substantially planar corrugated member having opposed surfaces thereon, each surface having a plurality of open grooves formed therein, a conductive layer being disposed in each of the grooves, the conductive layers being in electrical contact with each other;

an electrical conductor being disposed in at least one of the grooves on each surface of the corrugated member, each conductor having an axis therethrough, the axes of the conductors lying on a common, substantially linear, locus;

a first and a second sheath member respectively disposed adjacent to each of the surfaces of the corrugated member and in mechanical contact with the surface of the corrugated member to which it is adjacent;

an adhesive layer disposed between each sheath member and the corrugated member, each sheath member and the corrugated member cooperating to close the open groove having the conductor therein and thereby to define an enclosed tubular envelope, the envelope receiving the electrical conductor disposed therein along its entire length;

the conductive members being, in use, at a predetermined potential such that each conductor is substantially electromagnetically isolated along its entire axial length.

11. The cable of claim 10 wherein the conductors comprise a wire surrounded by an insulating jacket formed of a foamed plastic material.

12. The cable of claim 11 wherein the corrugated member has a groove adjacent each lateral edge thereof, and wherein a drain wire is disposed in each such groove, the drain wires each being dimensioned the same as the dimensions of the conductors.

13. A cable comprising:

a substantially planar corrugated member having opposed surfaces thereon, each surface having a plurality of open grooves formed therein, a conductive layer being disposed in each of the grooves, the conductive layers being in electrical contact with each other;

an electrical conductor being disposed in at least one of the grooves on each surface of the corrugated member, each conductor having an axis therethrough, the axes of the conductors lying on a common, substantially linear, locus, each conductor having a wire surrounded by an insulating jacket of a foamed plastic material;

a first and a second conductive member respectively disposed adjacent to each of the surfaces of the corrugated member and in electrical contact with the conductive layers on the surface of the corrugated member to which it is adjacent;

an adhesive layer disposed between each conductive member and the corrugated member, each conductive member and the conductive layer with which it is in contact cooperating to close the open groove having the conductor therein and thereby to define an enclosed tubular envelope, the envelope receiving the electrical conductor disposed therein along its entire length, the conductive members and the conductive layers being adhered to each other to form a semi-rigid structure which protects the foamed plastic material on the conductor and being, in use, at a predetermined potential such that each conductor is substantially totally electromagnetically isolated along its entire axial length.

14. A cable comprising:

a substantially planar corrugated member having opposed surfaces thereon, each surface having a plurality of open grooves formed therein, a conductive layer being disposed in each of the grooves, the conductive layers being in electrical contact with each other;

an electrical conductor being disposed in at least one of the grooves on each surface of the corrugated member, each conductor having an axis therethrough, the axes of the conductors lying on a common, substantially linear, locus, each conductor having a wire surrounded by an insulating jacket of a foamed plastic material;

a first and a second sheath member respectively disposed adjacent to each of the surfaces of the corrugated member and in mechanical contact with the surface of the corrugated member to which it is adjacent;

an adhesive layer disposed between each sheath member and the corrugated member, each sheath member and the corrugated member with which it is in contact cooperating to close the open groove having the conductor therein and thereby to define an enclosed tubular envelope, the envelope receiving an electrical conductor disposed therein along its entire length;

the sheath members and the corrugated member being adhered to each other to form a semi-rigid structure which protects the foamed plastic material on the conductor;

the conductive members being, in use, at a predetermined electrical potential such that each conductor is substantially electromagnetically isolated along its entire optical length.

15. A method of forming a cable comprising the steps of:

(a) laying a first and a second array of conductors on opposite sides of a metallic strip, a predetermined lateral spacing being defined between the conductors in each array;

(b) compressing the conductors in each array toward the strip such that a corrugated structure is formed with the axes of the conductors lying on a substantially linear locus;

(c) folding the strip along a first fold line substantially parallel to the axes of the conductors to overlay the strip over the first array of conductors; and (d) folding the strip along a second, spaced, fold line substantially parallel to the axes of the conductors to overlay the strip over the second array of conductors.

16. A method of forming a cable comprising the steps of:

(a) laying a first array of conductors on one surface of a metallic strip, a predetermined lateral spacing being defined between the conductors in that array;

(b) compressing the conductors in the array toward the strip to impart to the strip a corrugated structure having a plurality of grooves defined on the second surface of the strip;

(c) laying a second array of conductors in the grooves formed on the second surface of the strip;

(d) folding the strip along a first fold line substantially parallel to the axes of the conductors to overlay the strip over the first array of conductors; and (e) folding the strip along a second spaced fold line substantially parallel to the axes of the conductors to overlay the strip over the second array of conductors.

* * * * *